United States Patent [19]

Ulle

[11] Patent Number: 5,005,468

[45] Date of Patent: Apr. 9, 1991

[54] SWING CHUCKING DEVICE

[75] Inventor: Detlef Ulle, Reichelsheim, Fed. Rep. of Germany

[73] Assignee: Delaware Capital Formation, Inc., Wilmington, Del.

[21] Appl. No.: 465,741

[22] Filed: Jan. 17, 1990

[30] Foreign Application Priority Data

Jan. 21, 1989 [DE] Fed. Rep. of Germany ..... 3901740

[51] Int. Cl.[5] ..... F01B 3/00

[52] U.S. Cl. ..... 92/33; 92/31; 92/165 R; 74/99 A

[58] Field of Search ..... 92/31, 32, 33, 165 R, 92/116; 74/99 A

[56] References Cited

U.S. PATENT DOCUMENTS

| | | | |
|---|---|---|---|
| 1,602,209 | 10/1926 | Proell | 92/31 |
| 3,143,932 | 8/1964 | Lanman | 92/31 |
| 3,264,949 | 8/1966 | Dietlin | 92/31 |
| 3,274,901 | 9/1966 | Yost | 92/31 |
| 3,421,600 | 1/1969 | Gleason et al. | 92/31 |
| 3,776,106 | 12/1973 | Pish | 74/99 A |
| 3,967,535 | 7/1976 | Rozawsky | 92/39 |
| 4,359,932 | 11/1982 | Chilpers | 92/31 |
| 4,504,038 | 3/1985 | King | 92/31 |

FOREIGN PATENT DOCUMENTS

| | | | |
|---|---|---|---|
| 227351 | of 1910 | Fed. Rep. of Germany | 74/99 A |
| 1910861 | 11/1970 | Fed. Rep. of Germany | 92/31 |
| 2060547 | 9/1971 | Fed. Rep. of Germany | 92/31 |
| 2832371 | 1/1980 | Fed. Rep. of Germany | 192/31 |
| 3308109 | 9/1984 | Fed. Rep. of Germany | 92/31 |
| 0167505 | 10/1982 | Japan | 92/31 |
| 518238 | 2/1940 | United Kingdom | 92/31 |

*Primary Examiner*—John T. Kwon
*Assistant Examiner*—Thomas Denion
*Attorney, Agent, or Firm*—Lloyd M. Forster

[57] ABSTRACT

The swing clamping device consists of a cylinder (2) provided with fluid medium connections with a piston (5) that can be advanced and retracted and a piston rod (1) to whose free end a clamping arm (17) is attached. The piston rod swing guide is designed in the form of a swing guide sleeve (3) with a swing guide slot that runs along its entire length and is axially fixed in the cylinder interior on the piston rod side leaving an admission area of the piston (1) free on the piston rod end, and there is a swing transmission element between the guide sleeve and the piston rod (1). This device is designed according to this invention such that the cylinder (2) is designed in the shape of a pot with its opening facing toward the clamping arm and is guided precisely in it with its upper end in the area of the open end of cylinder (2) and at least in the area of its lower end (3') by the inside wall (2'') of the cylinder, so it can be inserted together with the piston rod (1) and respective pistons (5) as a swing guide sleeve (3) that forms one unit. The swing guide slot in the sleeve (3) is designed in the form of a slot (7) that is closed at both ends and passes through wall (3'') of sleeve (3). The free end (8) of a guide pin (9) that is secured so it can be inserted into piston rod (1) is engaged in this slot (7).

12 Claims, 2 Drawing Sheets

FIG. 3
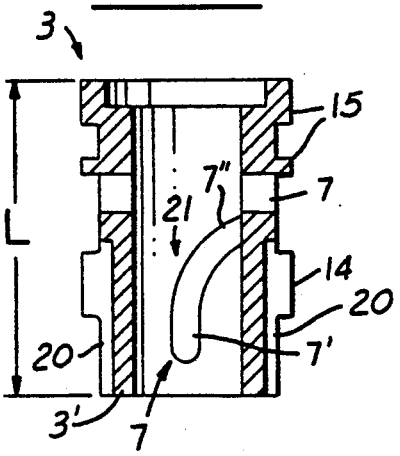
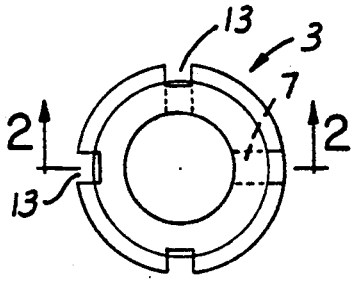
FIG. 4
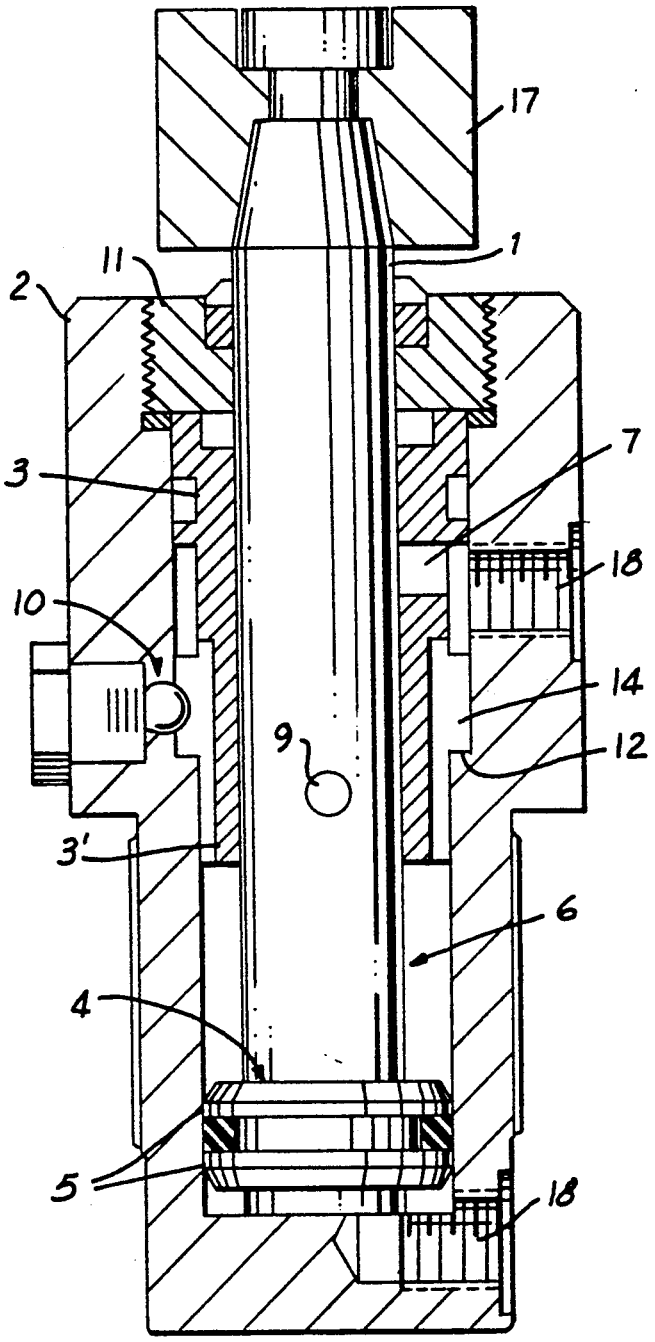
FIG. 5

SWING CHUCKING DEVICE

BACKGROUND OF THE INVENTION

This invention concerns a swing clamping device, especially for holding workpieces on a substrate according to the introductory clause of the main claim.

Such a swing clamping device is known by use. The cylinder is sealed on the end away from the clamping arm with a flange connecting plate, and the swing guide sleeve for the piston rod, which has a relatively small diameter with respect to the inside diameter of the cylinder, is secured only in and on a relatively short bore of the upper cylinder bottom which forms a unit with the cylinder. Apart from the fact that the cylinder is accessible only from its mounting-side end, installation and removal of the piston rod with the piston (with the clamping arm removed) and the guide sleeve are possible only from the mounting side of the cylinder, the swing guide slot for the piston must remain open in order to be able to remove the piston rod from the guide sleeve at all if it is to remain in the cylinder. A guide slot that is open at the end, however, is more or less unstable to a certain extent because it can be spread apart more or less conically unless it is overdimensioned with regard to its wall thickness.

GENERAL DESCRIPTION OF THE PRESENT INVENTION

Therefore, this invention is based on the problem of improving such a swing clamping device so that the swing guidance sleeve, the piston rod with the piston and optionally also the clamping arm can be inserted into the cylinder from the side remote from the mounting and can also be removed again from that side simply by means of an opening operation on the clamping arm side of the cylinder with a stable and positionally accurate mounting of the swing guide sleeve in the cylinder and the stablest possible guidance of the coupling member between the sleeve and the piston rod.

This problem is solved with a swing clamping device of the type defined initially according to this invention by the features cited in the characterizing part of the main claim. Advantageous refinements and practical implementations can be derived from the subclaims.

Despite the fact that there is a clear structural separation between the components of the device, namely the cylinder on the one hand and the piston, piston rod, and guide sleeve on the other hand, a reliable and precise pivoting guidance of the piston rod is also possible with the solution according to this invention, even taking into account the special load conditions resulting from the pivot guidance, due to the fact that the guide sleeve does not simply project freely into the interior of the cylinder but is also held against the inside wall of the cylinder with its end area on the piston side; and furthermore the guide slot is closed in this end area and thus can better absorb loads acting in this direction which would otherwise lead to spreading of the circumference. This design of the guide slot is possible especially because the component parts that are movable relative to each other can be inserted as a subassembly installation unit into the cylinder and of course can also be removed again in that way, which requires only a single operation to open the piston rod side of the cylinder. This insertion unit can be assembled completely independently of the cylinder so the introduction of the coupling element between the piston rod and the guide sleeve does not pose any problem despite the fact that the guide slot is closed on both ends because it is no longer necessary to accommodate the possibility of uncoupling the piston rod and guide sleeve which might otherwise be necessary for installation and removal of these component parts with respect to the cylinder.

In contrast to the device according to German Patent No. A 1,946,320 and devices of a similar type, the actual piston guidance space in the cylinder remains completely free of built-in parts and the piston rod need not be designed in a tubular or bushing-like arrangement because it need not engage a guide pin projecting from the bottom. Instead it fits concentrically in the guide sleeve which is itself positioned concentrically in the top part of the interior of the cylinder. Accordingly, added structural provisions required for pin guidance that engages in the piston rod, as well as the problems resulting from such design, are avoided. Since the piston rod engages the guide sleeve within the cylinder from beneath, the entire length of the guide sleeve is effective for the guidance of the piston rod in any position of the piston rod. The requirement for the simplest possible design and simple possibility of replacement of parts subject to wear and breakage is also satisfied because, as mentioned above, such elements can easily be installed and removed from one side with no problem by simply inserting and removing a subassembly of the piston rod and guide sleeve assembled outside the cylinder.

Although not absolutely necessary, an advantageous refinement consists in providing a diameter of the interior cylindrical space holding the guide sleeve which is larger than the diameter of the piston guide space. The cross sections of the guide sleeve and piston rod can be designed for corresponding strength accordingly; and the piston with its ring seals can be inserted more easily without any risk to these seals which would otherwise have to fit tightly at the opening edge where the fluid medium is supplied and would have to be pushed past a torsion overload safety device, if present.

It is important that with regard to the guidance of the lower end of the guide sleeve on the cylinder inside wall, access of the fluid medium supplied for the lowering and clamping stroke to the respective actuating surfaces of the piston to be kept free, as explained in greater detail below.

The guide sleeve arranged in the upper half of the interior of the cylinder is preferably designed with regard to its guidance function so its length corresponds at least to the length of the piston stroke plus the diameter of the guide pin.

As mentioned above, the piston, piston rod and guide sleeve should be subassembled as a unit before installation in the cylinder because this also yields an advantageous and extremely simple design of the cylinder, namely where it is designed simply like a pot, i.e., it needs only a closure on the piston rod side in the form of a ring running around the piston rod and sealing it in which case said ring can also be preassembled and mounted on the piston rod unless the insertion unit of the piston, piston rod and guide sleeve should also already be provided with the clamping arm. However, it is possible and even simpler to simply equip the guide sleeve with a connecting and sealing flange at the upper end.

The above-mentioned step in diameter of the cylinder interior is utilized to advantage to form a shoulder at about half the length of the interior of the cylinder so the guide sleeve engages the shoulder and can be secured there axially between the shoulder and the ring or flange forming the closure on the piston rod side. For this purpose, the sleeve is provided with a ring collar that has at least one passage for fluid medium to pass through, so the collar engages the shoulder and is also responsible for guiding the sleeve end on the inside wall of the cylinder. Furthermore, in a refinement of this version, the guide sleeve is provided with guide rings next to the wall of the interior of the cylinder so an annular space is formed between the cylinder wall and the guide sleeve for the distribution and supply of fluid medium. One of these ring collars but especially the one engaging the shoulder on the inside wall of the cylinder is utilized in an advantageous way to position an elastic torsion fixing lock in the area of the cylinder interior between the sleeve and the wall of the interior. Such torsion locks per se are known in the art.

In the present case, such a torsion lock is used so the guide sleeve of the cylinder can be released from the barrier and can twist when the clamping arm encounters an obstacle. The arrangement of such a barrier is possible, however, only when the closure on the side of the piston rod is not designed as an integral part (flange) of the sleeve.

In order to better distribute the loads occurring on the swing guide slot, it is also readily possible to provide two opposite swing guide slots with a corresponding shape on the guide sleeve so the guide pin sitting in the piston rod engages in it with its two ends.

With regard to the effect of its return pivot stroke out of the clamping position the device according to this invention is also suitable for inducing this movement with a restoring spring because a compression spring can easily be used in a known way in the piston stroke space between the piston and the cylinder.

The swing clamping device according to this invention will be explained in greater detail below with reference to illustrations of practical examples in the figures which show the following:

FIG. 3 shows a sectional view along line II—II according to FIG. 4 on a reduced scale which also shows the guide sleeve in a practical embodiment;

FIG. 4 shows a top view of the guide sleeve according to FIG. 3; and

FIG. 5 shows a sectional view through the swing clamping device according to FIG. 2 in the clamping position.

Figure 1:
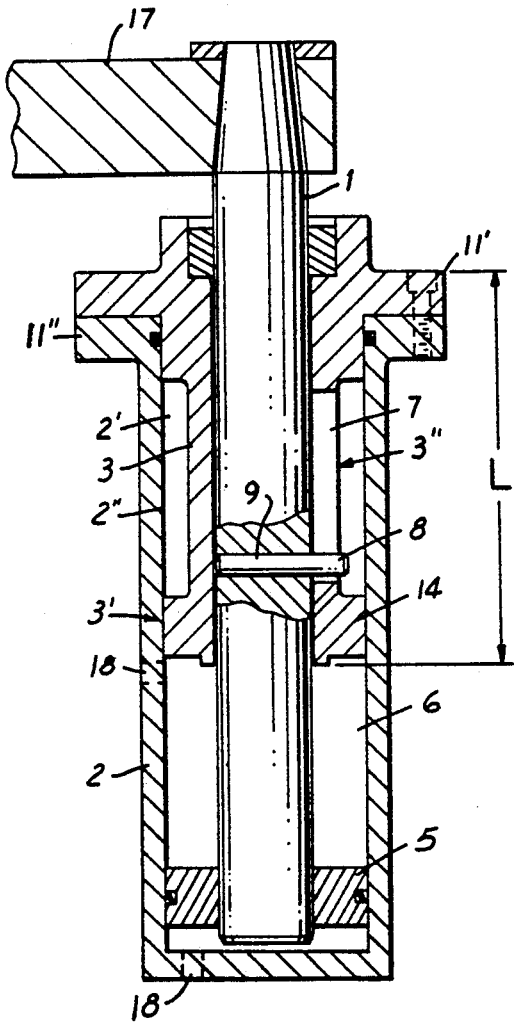
FIG. 1 shows a sectional and highly schematic view of the swing clamping device according to this invention in principle in the clamping position.
Figure 2:
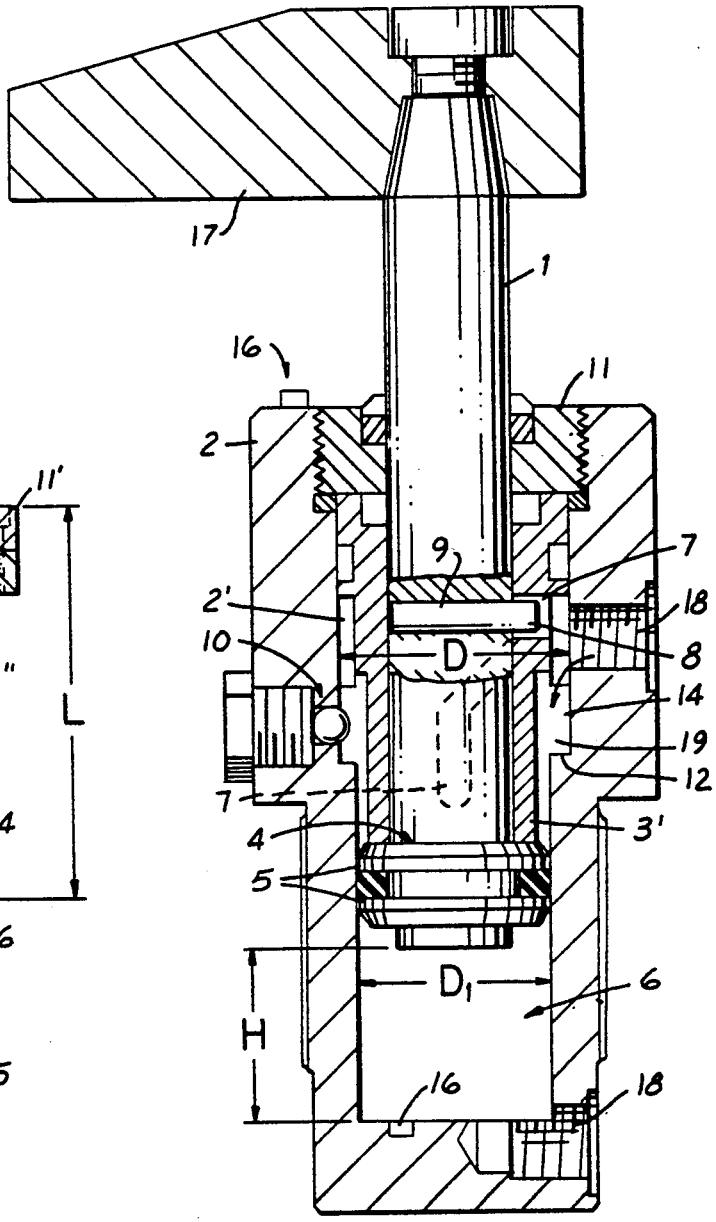
FIG. 2 shows a sectional view of the swing clamping device in a practical embodiment with the piston rod extended, i.e., in the release position.

In the simple version according to FIG. 1, the swing clamping device consists of a cylinder 2 that is provided with connections 18 for fluid medium and has a piston 5 that can be advanced and retracted and a piston rod 1 on whose free end clamping arm 17 is attached in a suitable manner so it is secured against twisting. In a simple version according to FIG. 1, the ring 11 of the embodiment according to FIG. 2 is replaced by an integral flange 11′ on guide sleeve 3 engaging a corresponding flange 11″ of cylinder 2 and connected to it in such a way that it can be detached. The fluid medium connection for the lowering and clamping stroke is located beneath ring collar 14′ and suitable means must be provided to assure that the load surface of piston 5 on which the fluid medium acts must be accessible. This swing clamping device consists of a piston rod swing guide with a swing guide slot 7 between which and the piston/piston rod unit the swing transmission element is located.

The piston rod swing guide is designed with its guide sleeve 3 that extends along its entire length L and is secured axially and against rotation in cylinder 2 in the interior 2′ of cylinder 2 on the clamping arm end. The guide sleeve 3 is shown in a specific embodiment more clearly in FIG. 3. This guide sleeve 3 is located in interior 2′ in the embodiment according to FIG. 2, leaving a load surface 4 of piston 5 for the fluid medium to act on free on the side of the piston rod so the fluid medium supplied through the upper connection 18 for the lowering and clamping stroke can reach the load surface 41 as indicated with arrow 19 in FIG. 2 and thus press piston 5 downward with piston rod 1. In the embodiment according to FIG. 2, the oncoming flow passage leading to load surface 4 on which the fluid medium acts is left free by the simple measure that the outside of the guide sleeve 3 in this area is provided with several axial grooves 20, which also engage the ring collar 14 which provides the concentric bearing for the guide sleeve on the lower end in the cylinder. As indicated with dotted lines, a passage is provided in the wall of sleeve 3 forming the swing guidance slot 7 into which the free end 8 of guide pin 9 fixed in piston rod 1 engages as a coupling element. The relatively small remaining ring-shaped area of the load surface 4 on which the fluid medium acts and which is defined by the load surface coming to rest against the lower edge 3′ of guide sleeve 3 is not a disadvantage because immediately after the piston load surface 4 has lifted up from edge 3′, the entire load surface 4 is available. Apart from this fact, however, the lower edge 3′ of guide sleeve 3 could also be designed like a notch in order to increase the actual load surface at the beginning of admission of the fluid medium.

Due to the fact that the free end 8 of guide pin 9 is engaged in guide slot 7, piston rod 1 experiences a corresponding rotation as is usual in such swing clamping devices in accordance with the cam guidance in the lowering stroke of the piston rod. In the return stroke from the position according to FIG. 5, the lower fluid medium connection 18 is acted on, and the upper fluid medium connection is released so piston rod 1 and clamping arm 17 attached to it can be pivoted back in the opposite direction and enter the position according to FIG. 2. As mentioned above, the return stroke can also be effected readily be means of a compression spring (not shown here) that could be inserted into the piston guide space 6.

In order to be able to design and arrange guide sleeve 3 as shown in FIG. 2, the diameter D of the interior 2′ must be larger than the diameter $D_1$ of the piston guide space 6.

This difference in diameters is utilized in an advantageous manner to form a shoulder 12 on which the ring collar 14 of guide sleeve 3 can engage so the sleeve 3 is secured axially between the shoulder 12 and the ring 11 to be screwed into cylinder 2 at the top in the embodiment according to FIG. 2. There are various possibilities for securing guide sleeve 3 which together with its guide slot 7 forms the abutment or the support for the rotational movement of piston rod 1 to prevent twisting of the guide sleeve, namely be means of suitably positioned projections or grooves. However, it is advantageous to provide guide sleeve according to the practical example (FIG. 2) with ring collar 14 which has at least one fluid medium passage 13 on the cylinder wall so the ring collar also acts as a support for sleeve 3 on shoulder 12 and is a guide for cylinder wall 2'. Then an elastic torsion lock 10 is positioned in the area of this ring collar 14 and may consist as shown here of a ball acted on by a washer spring. Of course the spring must be designed so it can resist the normal pressure occurring on the sides of the guide slot 7 due to the end 8 of guide pin 9 projecting inward. However, such a torsion lock will respond immediately when clamping arm 17 strikes an obstacle at the side which could lead to breakage of the guide pin if guide sleeve 3 were secured in the cylinder so it was absolutely prevented from turning.

In order to form the largest possible friction surface between the inside wall 2'' and guide sleeve 3 on the one hand and to create the largest possible passage for the fluid medium supplied through upper connection 18, guide sleeve 3 is provided with guide collars 15 on the wall of the cylinder interior 2'.

As this shows, in the embodiment according to FIGS. 2 to 5, the guide sleeve with a suitably reduced diameter has its other end engaged in the cylinder interior with a reduced diameter and its lower edge 3' forms the upper stop for piston 5.

If wear becomes apparent on guide sleeve 2 or on guide pin 9 and/or guide slot 7 with respect to the accuracy in positioning clamping arm 17 or if guide pins 9 break, then it is extremely simple to replace these elements because all that is necessary is to unscrew ring 11 or loosen flange 11' and then the entire piston rod with piston 5 and guide sleeve 3 can be simply removed from cylinder 2. The same thing is of course also true when the device is to be fitted with a different guide sleeve which is to impart a different rotational and/or stroke movement to piston rod 1. Before removing the piston rod together with sleeve 3, torsion lock 10, if present, must of course be released.

With regard to slot 7 which forms the swing guide slot, it is designed in the form of a steadily connecting curve 21 in the transitional area from part 7' to the oblique part 7'' so there is a "soft" and smooth transition of guide pin 9 from one part to the other which essentially has the effect of reducing wear and increases the lifetime of the device.

I claim:

1. Swing clamping device consisting of a cylinder provided with fluid medium connections with a piston and piston rod that can be advanced forward and retracted with a clamping arm attached to the free end, a piston rod swing guide in the form of a swing guide sleeve with a swing guide slot that runs along its length and is axially and rotationally secured in the cylinder interior on the piston rod end leaving a load surface of the piston free on the piston rod side, and a swing transmission element arranged between the swing guide slot and the piston rod, characterized in that the cylinder (2) is designed with one closed end with its opening oriented toward the clamping arm which is guided precisely in it by the cylinder interior wall (2'') with its upper end in the area of the open end of cylinder (2) and at least in the area of its lower end (3'), by the swing guide sleeve (3) that forms a unit together with the piston rod (1) and the respective piston (5) that can be built in as a unit, in which case the swing guide slot of sleeve (3) is designed in the form of a slot (7) that is closed at both ends and passes through wall (3'') of sleeve (3) and the free end (8) of a guide pin (9) that is secured in the piston rod (1) so it cannot move is arranged there.

2. Device according to claim 1, characterized in that the diameter (D) of the cylinder interior (2') is larger above the piston guide space (6) than the diameter ($D_1$) of the piston guide space (6).

3. Device according to claim 1, characterized in that the length (L) of the guide sleeve (3) corresponds at least to the length of the piston stroke (H) plus approximately one diameter of the guide pin (9).

4. Device according to claim 1, characterized in that the guide sleeve (3) is provided with a ring collar (14) against the cylinder inside wall (2'') at its lower end which has at least one fluid medium passage (13) on the side of the cylinder wall.

5. Device according to claim 1, characterized in that the guide sleeve (3) is provided with guide journals (15) in contact with the wall of the cylinder interior (2').

6. Device according to claim 1, characterized in that an elastic torsion lock (10) is provided between the sleeve (3) and the wall of the interior (2') in the area of the cylinder interior (2').

7. Device according to claim 1, characterized in that two opposing swing guide slots (7) are arranged on guide sleeve (3) with corresponding running cam guidances and the guide pin (9) is in engagement with them at both of its ends (8).

8. Device according to claim 1, characterized in that the pot-shaped cylinder (2) is closed with a ring (11) that extends around the circumference of the piston rod (1) and forms a seal, and its outside diameter is larger than that of the guide sleeve (3).

9. Device according to claim 1, characterized in that the guide sleeve (3) is provided at its upper end with a flange (11') which is detachably connected to the upper edge of cylinder (2).

10. Device according to claim 8, characterized in that guide sleeve (3) is arranged between ring (11) and a shoulder (12) bordering the interior space (2') so it is axially secured.

11. Device according to claim 1, characterized in that the guide sleeve (3) is provided at its upper end with a flange (11') that is detachably connected to the upper edge of cylinder (20).

12. Device according of claim 1, characterized in that the transition area from part (7') to the oblique part (7'') on the slot (7) of the transition area that forms the swing guide slot is designed in the form of a smooth curve (21).

* * * * *